US006636133B2

(12) United States Patent
Raabe et al.

(10) Patent No.: US 6,636,133 B2
(45) Date of Patent: Oct. 21, 2003

(54) PTC TERMINALS

(75) Inventors: Rodney Raabe, Cedar Rapids, IA (US); Scott E. Rogers, Robins, IA (US)

(73) Assignee: Square D Company, Palatine, IL (US)

( * ) Notice: Subject to any disclaimer, the term of this patent is extended or adjusted under 35 U.S.C. 154(b) by 46 days.

(21) Appl. No.: 09/952,533

(22) Filed: Sep. 14, 2001

(65) Prior Publication Data

US 2003/0052762 A1 Mar. 20, 2003

(51) Int. Cl.[7] ..... H01H 83/06
(52) U.S. Cl. ..... 335/18; 335/35
(58) Field of Search ..... 335/16

(56) References Cited

U.S. PATENT DOCUMENTS

| | | | | | |
|---|---|---|---|---|---|
| 4,165,502 | A | * | 8/1979 | Andersen | 335/39 |
| 4,417,222 | A | * | 11/1983 | Schmitt et al. | 335/6 |
| 5,023,416 | A | * | 6/1991 | Oyama et al. | 200/244 |
| 5,424,699 | A | * | 6/1995 | Goble | 335/16 |
| 5,910,760 | A | | 6/1999 | Malingowski | 335/167 |
| 6,262,372 | B1 | * | 7/2001 | Naegelin et al. | 174/68.1 |
| 2003/0027447 | A1 | * | 2/2003 | Cooper et al. | 439/181 |

FOREIGN PATENT DOCUMENTS

| | | | | | |
|---|---|---|---|---|---|
| DE | 3206462 | A1 | | 2/1982 | H01H/71/10 |
| EP | 0867895 | A2 | | 3/1998 | H01C/7/02 |
| JP | 2000-164109 | | | 6/2000 | H01H/73/18 |
| JP | 2000164109 | A | * | 6/2000 | H01H/73/18 |

OTHER PUBLICATIONS

Carpenter Specialty Alloys No. 1 JR Alloy (Types 1, 2 and 4), 2–88, p. 32.

Abstract for Japanese Patent No. 01072440, 2 pages.

* cited by examiner

*Primary Examiner*—Elvin Enad
*Assistant Examiner*—Bernard Rojas
(74) *Attorney, Agent, or Firm*—Larry I. Golden

(57) ABSTRACT

A circuit breaker comprises a line terminal, a middle terminal, and a load terminal, at least one of which is constructed from a positive temperature coefficient material and configured for introducing a predetermined resistance into the current path of the circuit breaker. The predetermined resistance is intended to limit current reaching a bi-metallic trip element as temperature rises so as to protect the bi-metallic trip element from excessive thermal stress, where the predetermined resistance increases with the increased temperature.

10 Claims, 8 Drawing Sheets

PTC TERMINALS

FIELD OF THE INVENTION

The invention is directed to improvements in circuit breakers and more particularly to a novel and improved method and structure for protecting a thermal trip assembly of a circuit breaker from excessive thermal energy.

BACKGROUND OF THE INVENTION

In circuit breakers having a thermal trip mechanism, the mechanism is also responsive to a thermal energy responsive element such as a bi-metallic element for tripping the breaker to an open position. For example, a bi-metallic strip deforms so as to activate or trigger a trip mechanism of the breaker in response to a predetermined current/time profile of current flowing through the breaker which reflects the current flowing through the circuit to be protected by the breaker. The mechanism rotates the moveable contact assembly so as to open the current path by moving the moveable contact away from the fixed contact.

The thermal mechanism should be protected from excessive thermal energy to avoid damage to the bi-metallic element and/or other elements of the thermal trip assembly. However, this must be done in such a way as not to interfere with the desired sensing and reactions to current flowing through the breaker by other trip mechanisms including an electromagnetic trip mechanism and a blow back function (described below).

Accordingly, one or more positive temperature coefficient resistance elements have heretofore been added to the current path. These resistances elements have a relatively low resistance at normal ambient operating temperatures and the resistance increases according to a given resistance versus temperature curve or profile, which may be specified in the design of the PTC element and/or material. However, given constraints of space and cost for circuit breakers of this type, it is not generally economically feasible to design, specify and add yet further components to the current path. Moreover, the addition of yet further components such as additional PTC resistance elements, further increases the complexity and expense of fabrication and assembly of the breaker.

SUMMARY OF THE INVENTION

Accordingly, the invention provides for one or more pre-existing elements in the breaker current path to be constructed of a suitable positive temperature coefficient material and to be appropriately configured and dimensioned to present a desired PTC profile for increasing resistance in the current path in response to increasing temperature in such a manner as to protect the thermal trip elements of a breaker without compromising operation of other trip mechanisms of the breaker.

DETAILED DESCRIPTION OF THE ILLUSTRATED EMBODIMENT

Figure 1:
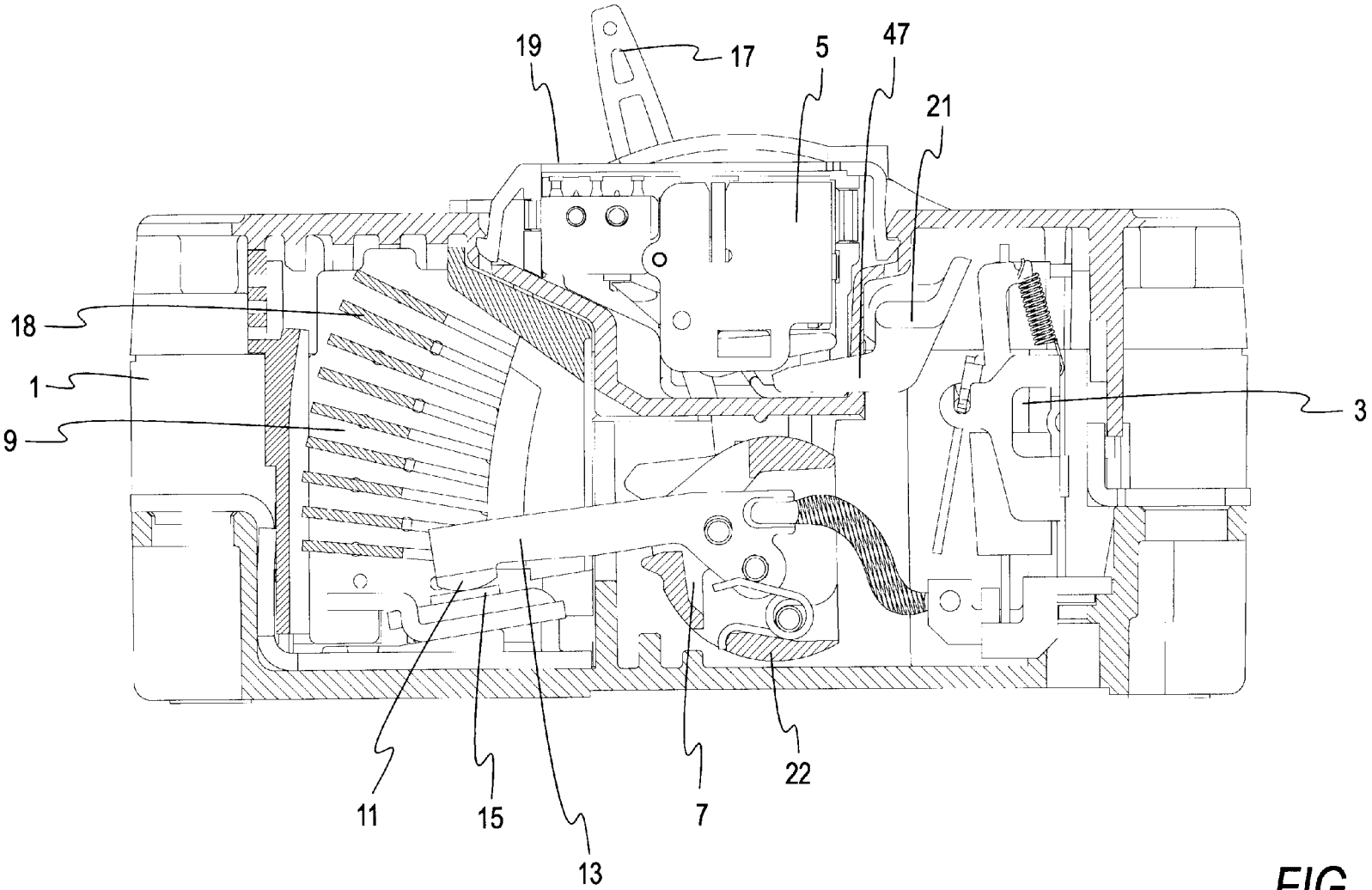
FIG. 1 is a cross-sectional view of a circuit breaker embodying the present invention shown in the closed position.
Figure 2:
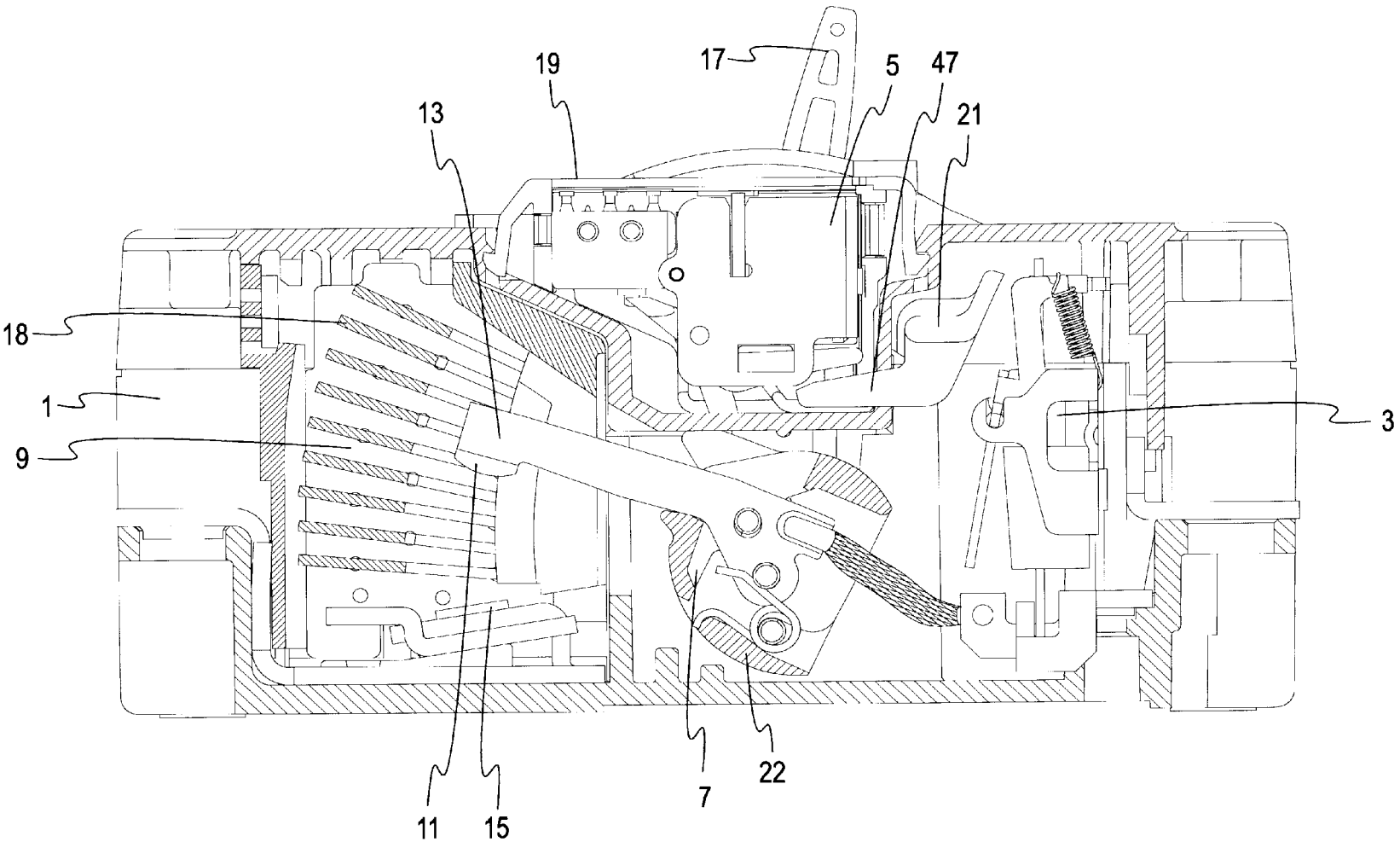
FIG. 2 is a cross-sectional view of a circuit breaker embodying the present invention shown in the open position.

Referring now to the drawings, and initially to FIGS. 1, 2, 3, and 4, a cross-sectional view of this invention shows a circuit breaker 1 in the closed, open, blown-open, and tripped positions, respectively. Circuit breaker 1 contains, generally, a tripping mechanism 3, a handle mechanism 5, a blade mechanism 7, and an arc extinguishing mechanism 9.

More specifically, when circuit breaker 1 is in the closed position, as shown in FIG. 1, a movable contact 11 that is attached to a blade 13, which in turn is part of blade mechanism 7, is in contact with a stationary contact 15. The connection that occurs between movable contact 11 and stationary contact 15 results in normal operation of the electrical system to which circuit breaker 1 is connected. Handle 17 is a part of handle mechanism 5, it protrudes through the circuit breaker's housing, and it may have one or more functions. For example, handle 17 can be used to manually reset the circuit breaker 1 and can serve as a visual guide to the status of circuit breaker 1. In the "closed" position, see FIG. 1, handle 17 is shown at the closed edge 19 of a handle slot, which is at the most counterclockwise position of the handle slot as viewed in FIG. 1. Also, a trip cross bar 21, which is part of tripping mechanism 3, is shown in its untripped position having the long surface of a finger 47 positioned in line with the horizontal plane.

The "open" position is a manually controlled position that allows an operator of circuit breaker 1 to stop the flow of current by separating movable contact 11 from stationary contact 15. The operator moves handle 17 to a position that is at an open edge of the handle slot, which is at the most clockwise position as viewed in FIG. 2. In this position blade 13 swings in a clockwise direction traveling just over a half of an imaginary arc created by a plurality of arc plates 18 in arc extinguishing mechanism 9. Trip cross bar 21 remains unchanged from its closed position.

Figure 3:
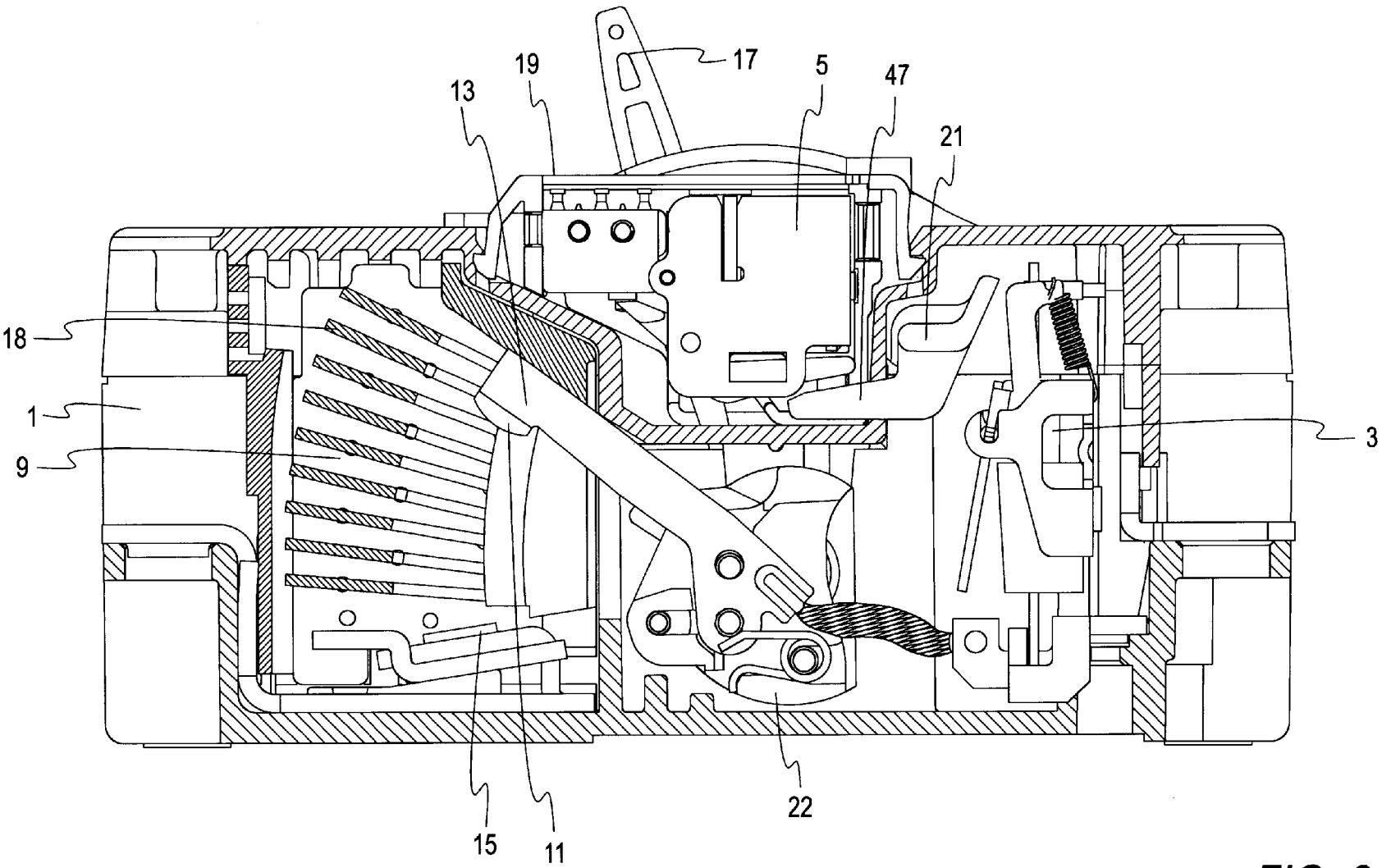
FIG. 3 is a cross-sectional view of a circuit breaker embodying the present invention shown in the blown-open position.

In the "blown-open" position, shown in FIG. 3, an electric current that has a higher value than the preset acceptable threshold by a certain percentage causes electromagnetic forces which overcome preapplied forces on blade 13. This results in blade 13 swinging in a clockwise direction through the passageway defined by the arc plates 18. However, in this position a blade housing 22 and trip cross bar 21 remain in the same position as in the "closed" and "open" positions. Similarly, handle 17 remains in the same position as in the "closed" position.

Figure 4:
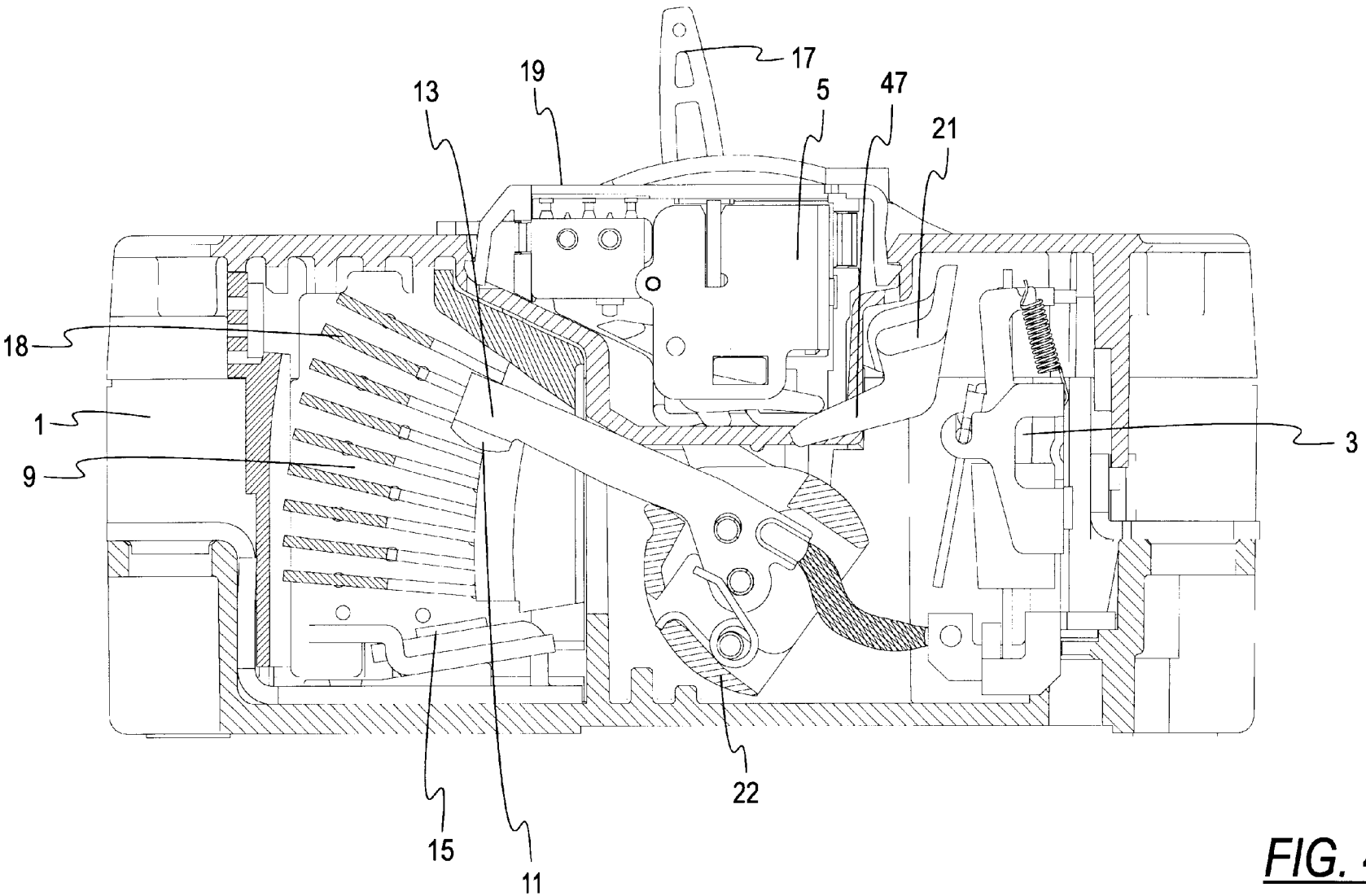
FIG. 4 is a cross-sectional view of a circuit breaker embodying the present invention shown in the tripped position.

The "tripped" position is caused by the presence of a higher current intensity than the assigned current intensity for circuit breaker 1 over a specified period of time. The exposure of circuit breaker 1 to a longer period of high current intensity activates tripping mechanism 3 that, as shown in FIG. 4, causes blade 13 and blade housing 22 to swing through the arc passageway in the clockwise direction, as viewed in FIG. 4, and therefore interrupt the current flow. Handle 17 remains in an intermediate position between the "closed" and "open" positions, wherein the operator must reset circuit breaker 1 by first pressing handle 17 to its "open" position before pressing handle 17 to its "closed" position. In this position trip cross bar 21 is shown in its activated state.

Figure 5:
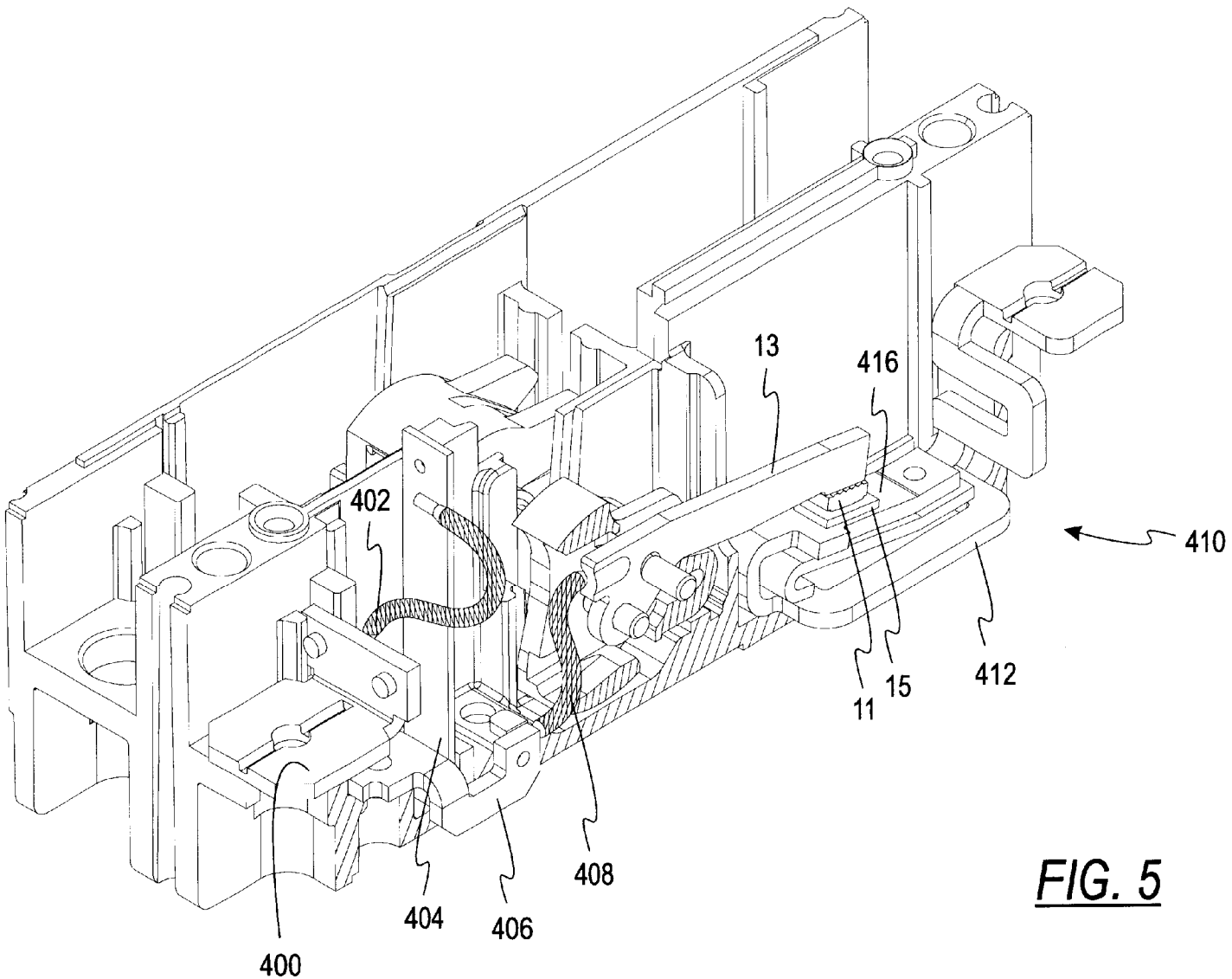
FIG. 5 is an isometric view of the circuit of FIGS. 1–3 showing further details of the current path.

Referring to FIG. 5, a partial isometric and partially cut-away view of a circuit breaker illustrates features of the current path and the fixed and moveable contact components. In this regard, current from the circuit to be protected flows into a load terminal 400, from a first flexible cable cable 402 through a bi- or tri-metallic element 404 which comprises part of the thermal trip mechanism or assembly of the breaker. Current to the bi-metal element 404 flows through a middle terminal element 406 and a second flexible cable connector or cable 408 at one end of the pivotally moveable blade member 13 which mounts the moveable contact 11 at its other end. The fixed contact 15 is mounted to the line terminal 410 which also contacts the line to be protected, thus forming a series circuit to a load through the breaker in series with the line to be protected.

In order to facilitate a blow open feature of the breaker, the line terminal 410 is reversely bent in order to reverse the direction of current flow and hence the electromagnetic field direction in the region of the fixed contact 15. This feature of the configuration of the line terminal is also shown in FIG. 6, to which reference is also invited.

In accordance with one feature of the invention, one or more of the line terminal 410, middle terminal 406 and/or load terminal 400 may be constructed of a positive temperature coefficient (PTC) material. This is done to present a desired resistance versus temperature profile for protecting the bi-metallic strip or element 404 from excessive thermal energy, without interfering with the current flow through the breaker in such a way as to compromise the operation of other trip features including the blowopen feature and electromagnetic trip feature of the breaker.

Figure 6:
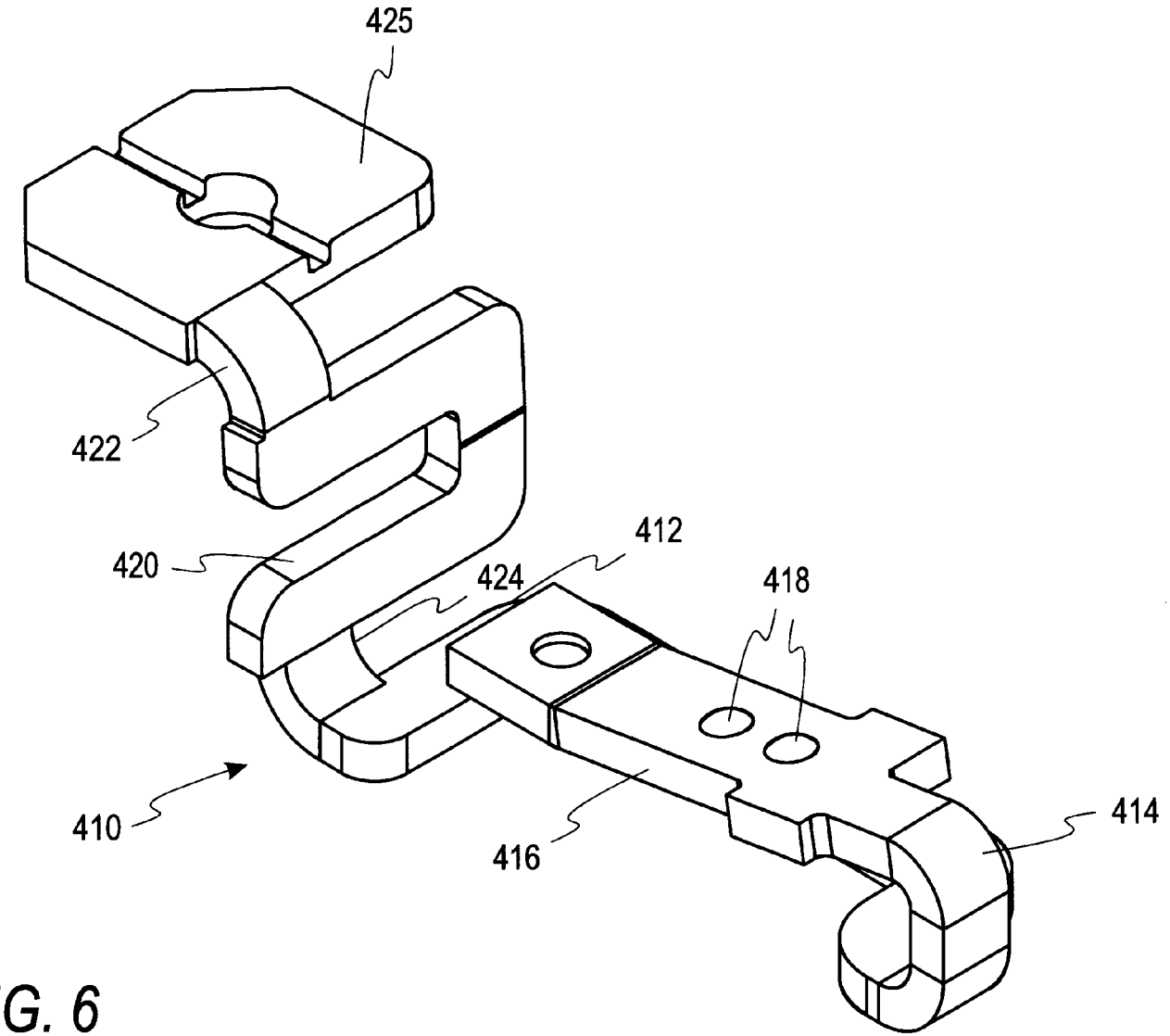
FIG. 6 is an isometric view of a PTC line terminal.
Figure 8:
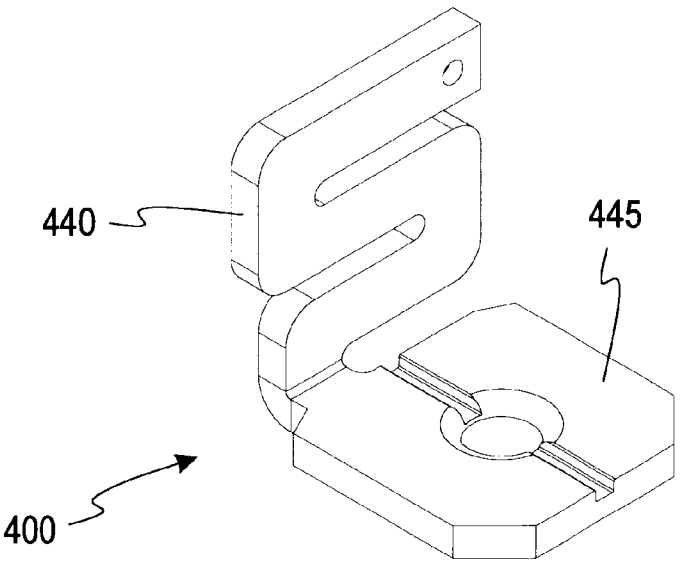
FIG. 8 is an isometric view of a PTC load terminal.
Figure 7:
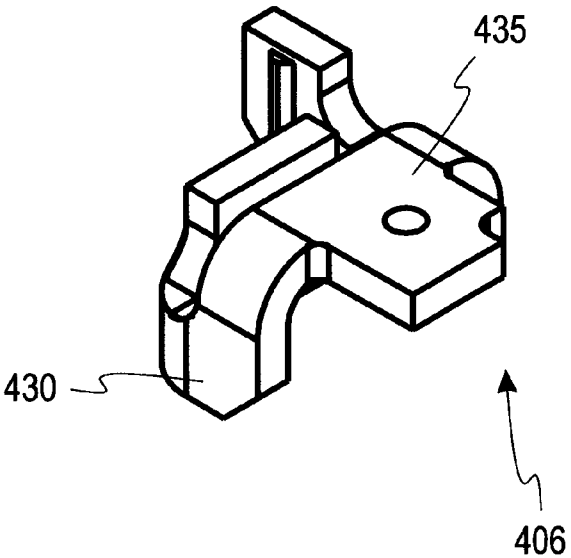
FIG. 7 is an isometric view of a PTC middle terminal.
Figure 11:
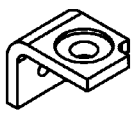
FIG. 11 is an isometric view of a non-PTC middle terminal.
Figure 10:
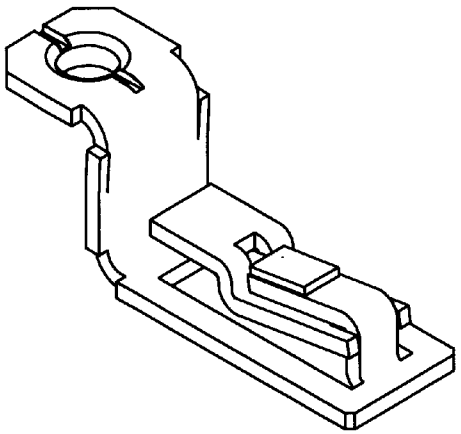
FIG. 10 is an isometric view of a non-PTC line terminal.
Figure 9:
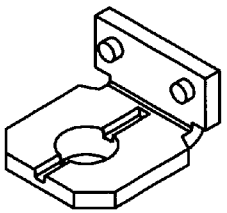
FIG. 9 is an isometric view of a non-PTC load terminal.

In this regard, FIGS. 6, 7 and 8 show the configuration of the line terminal middle terminal and load terminal when the same are constructed of PTC material. In one particular set of applications of the invention, both line and middle terminals of PTC material are used for a 15 amp breaker, whereas the middle terminal only is configured or constructed of PTC material in 20 amp and 25 amp breakers At lower amperages, (i.e., significantly below 15 amps) it may be desirable to construct all three terminals 400, 406, 410 of PTC material.

Referring now to FIG. 6, the line terminal 410 has a reverse bent configuration such that a first elongate arm 412 reverses at an area 414 to a second elongate arm 416 which has one or more apertures 418 for mounting the fixed contact 15. The amount of material used in the terminal 410 as well as its length in cross-sectional configuration help determine the resistance properties. In this regard, the terminal configuration 410 of FIG. 5 will be seen to differ from the usual terminal configuration as shown in FIG. 8, in a number of respects. These include a generally U-shaped or cut out areas 420, 422 and 424 which maintain the cross-sectional area of the terminal 410 substantially constant apart from the relatively enlarged connector tab 425. The arm 416 which mounts the fixed terminal is also somewhat larger in cross-sections.

FIG. 7 is an isometric view showing a PTC middle terminal 406. The terminal has an enlarged connection portion 435 and otherwise is of a generally constant and controlled cross-sectional dimension as indicated at reference numeral 430. Similarly, referring to FIG. 8, the load terminal 400 has an enlarged connector portion 445 and is otherwise of constant cross-section as indicated at reference numeral 440. In one specific embodiment, the cross-section of the constant cross-section portions of each of the line, middle and load terminal is 2 millimeters by 4 millimeters.

In an embodiment having this cross-section, a mid terminal 406 is 50 millimeters long, the blind terminal 410 is 100 millimeters long and the load terminal 400 is 40 millimeters long. In each case, the effective length refers to the constant cross-section portion of the respective terminals.

Also in accordance with one embodiment of the invention, when the line, load and middle terminals are formed of a PTC material, a material such as a number 1JR® alloy, available, for example from Carpenter Specialty Alloys may be used. This alloy is an oxidation-resistant steel which offers excellent electrical resistance properties, including high specific electrical resistance and low temperature coefficient of resistance. The alloy is available with varying aluminum contents to provide different resistivities.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker comprising:

a fixed contact;

a moveable contact, which is moveable into and out of electrically conductive engagement with said fixed contact;

a line terminal operatively coupling said fixed contact with a circuit to be protected by said circuit breaker;

a middle terminal operatively coupling said moveable contact with said circuit to be protected, in series with said line terminal, said fixed contact and said moveable contact;

a load terminal in series with said middle terminal and operatively coupling said circuit breaker to a load; and a trip mechanism responsive to at least a thermal trip element for causing the moveable contact to move out of engagement with the fixed contact in response to a given amount of thermal energy caused by current over time passing through a circuit breaker current path comprising said fixed contact, said movable contact, said line terminal, said middle terminal, said thermal trip element and said load terminal from a circuit to be protected;

wherein at least one of said line terminal, said load terminal, and said middle terminal is constructed of a positive temperature coefficient material and is configured for introducing a predetermined resistance into a current path in said circuit breaker so as to limit current reaching said thermal trip element as temperature rises, so as to protect said thermal trip element from excessive thermal stress, said predetermined resistance increasing with increased temperature.

2. The circuit breaker of claim 1 wherein said at least one of said line terminal, said load terminal and said middle terminal is configured and arranged having a predetermined length and cross-sectional configuration for presenting a predetermined temperature/resistance characteristic.

3. The circuit breaker of claim 1 wherein said line terminal is configured to present a reverse current path to said moveable contact for facilitating a blow open operation of said fixed contact relative to said moveable contact in response to electromagnetic forces developed in response to passage of a surge current of a predetermined magnitude through said current path through said circuit breaker.

4. The circuit breaker of claim 2 wherein said line terminal is configured to present a reverse current path to said moveable contact for facilitating a blow open operation of said fixed contact relative to said moveable contact in response to electromagnetic forces developed in response to passage of a surge current of a predetermined magnitude through said current path through said circuit breaker.

5. The circuit breaker of claim 1 wherein said thermal trip element comprises a bi-metal strip.

6. A method of controlling thermal energy in a circuit breaker having a fixed contact; a moveable contact, which is moveable into and out of electrically conductive engagement with said fixed contact; a line terminal operatively coupling said fixed contact with a circuit to be protected by said circuit breaker; a middle terminal operatively coupling said moveable contact with said circuit to be protected, in series with said line terminal, said fixed contact and said moveable contact; and a trip mechanism responsive to at least a thermal trip element for causing the moveable contact to move out of engagement with the fixed contact in response to a given thermal energy caused by current over time passing through a circuit breaker current path comprising said fixed contact, said movable contact, said line terminal, said middle terminal, said load terminal, and said thermal trip element from a circuit to be protected; said method comprising:

constructing at least one of said line terminal, said load terminal, and said middle terminal of a positive temperature coefficient material, and configuring at least one of said line terminal, said load terminal, and said middle terminal for introducing a predetermined resistance into a current path in said circuit breaker so as to limit current reaching said thermal trip element as temperature rises, so as to protect said thermal trip element from excessive thermal stress, said predetermined resistance increasing with increased temperature.

7. The method of claim 6 including configuring said at least one of said line terminal, said load terminal and said middle terminal with a predetermined length and cross-sectional configuration for presenting a predetermined temperature/resistance characteristic.

8. The method of claim 6 including configuring said line terminal to present a reverse current path to said moveable contact for facilitating a blowopen operation of said fixed contact relative to said moveable contact in response to electromagnetic forces developed in response to passage of a surge current of a predetermined magnitude through said current path through said circuit breaker.

9. The method of claim 7 including configuring said line terminal to present a reverse current path to said moveable contact for facilitating a blowopen operation of said fixed contact relative to said moveable contact in response to electromagnetic forces developed in response to passage of a surge current of a predetermined magnitude through said current path through said circuit breaker.

10. The method of claim 6 wherein said thermal trip element comprises a bi-metal strip.

* * * * *